US005435940A

United States Patent [19]

Doering et al.

[11] Patent Number: 5,435,940

[45] Date of Patent: Jul. 25, 1995

[54] GASIFICATION PROCESS

[75] Inventors: Egon L. Doering, Pasadena; Uday Mahagaokar, Houston, both of Tex.

[73] Assignee: Shell Oil Company, Houston, Tex.

[21] Appl. No.: 153,593

[22] Filed: Nov. 12, 1993

[51] Int. Cl.[6] ..... C07C 1/02; C10J 3/00

[52] U.S. Cl. ..... 252/373; 48/210; 48/198.7

[58] Field of Search ..... 252/373; 48/210, 198.7

[56] References Cited

U.S. PATENT DOCUMENTS

| | | | |
|---|---|---|---|
| 3,970,434 | 7/1976 | Gasior et al. | 44/1 F |
| 4,277,365 | 7/1981 | Paull et al. | 252/373 |
| 4,423,702 | 1/1984 | Ashworth et al. . | |
| 4,439,210 | 8/1984 | Lancet | 48/202 |
| 4,668,428 | 5/1987 | Najjar . | |
| 4,668,429 | 5/1987 | Najjar . | |
| 4,808,386 | 2/1989 | Najjar et al. . | |
| 4,826,627 | 5/1989 | Najjar . | |
| 4,876,031 | 10/1989 | Najjar et al. . | |
| 4,952,380 | 8/1990 | Najjar et al. . | |

FOREIGN PATENT DOCUMENTS 2116201 9/1983 United Kingdom .

*Primary Examiner*—Johann Richter

*Attorney, Agent, or Firm*—Timothy J. Hadlock

[57] ABSTRACT

A method for catalytically aiding the gasification of a bituminous coal or petroleum coke feed, which includes (a) mixing with a dry carbonaceous feed an additive compound selected from the group consisting of potassium, calcium, sodium, or magnesium carbonates, bicarbonates, or sulfates, and mixtures thereof; (b) gasifying the coal feed in the resulting mixture in an entrained flow gasifier under gasifying conditions and at a temperature of from about 2000° F. to about 3200° F., thus producing a gas primarily including hydrogen and carbon monoxide; and (c) where the additive compound catalytically aids in producing the hydrogen and carbon monoxide, whereby gasification occurs at moderate temperatures.

16 Claims, No Drawings

GASIFICATION PROCESS

FIELD OF THE INVENTION

The invention relates to a process of adding compounds of K, Ca, Na, or Mg to an anthracite coal, a bituminous coal, or petroleum coke feedstock for a gasification unit.

BACKGROUND OF THE INVENTION

The combustion of a carbonaceous material such as a solid carbonaceous fuel by reaction with a source of gaseous oxygen is well known. In such a reaction, an amount of air or oxygen equal to or greater than that required for complete combustion is used, and as a result the gaseous effluent contains carbon dioxide with little, if any, carbon monoxide. It is also known to carry out the gasification or partial oxidation of solid carbonaceous materials or fuels employing a limited quantity of oxygen or air so as to produce primarily carbon monoxide and hydrogen, i.e., synthesis gas.

Various problems are associated with the different types of feeds utilized in gasification processes. With liquid hydrocarbon and petroleum coke feeds there is insufficient ash content in the feed to create a satisfactory slag which is necessary to form a satisfactory insulating layer on the gasifier walls. Nickel and Vanadium build-up also occurs with such feeds if there is not a satisfactory slag flow down the gasifier walls to wash these compounds out of the gasifier. It is taught in. U.S. Pat. No. 4,668,428 that adding iron additives to liquid hydrocarbon and petroleum coke feeds to a gasifier can be beneficial in reducing the viscosity of the slag.

The problem of insufficient ash or nickel/vanadium build-up is not present in coal since coal has from 10–20 percent by weight ash and petroleum coke and heavy liquid hydrocarbons typically only have less than one percent by weight ash. Coal feeds, however, present different problems. Coals are classified according to their rank and BTU content and consequently have different reactivities.

Typically, the higher the BTU content the lower the reactivity of the coal with oxygen. The lower the reactivity the coal has with oxygen, the higher the temperature that is necessary to partially oxidize the coal into synthesis gas. The rating of coals and coke from the lowest BTU content and highest reactivity to the highest BTU content and lowest reactivity is lignite coals, sub-bituminous coals, bituminous coals, anthracite coals, and petroleum coke.

Since bituminous and anthracite coals and petroleum coke are at the top of the scale, they have the least reactivity and require the highest temperatures to obtain adequate conversion into synthesis gas. The high temperatures necessary for the gasification of anthracite or bituminous coal or petroleum coke reduces the efficiency of converting coal to synthesis gas. The high temperatures also shorten the life of the internal components of the gasifier reactor.

It would be advantageous to have a practical and efficient method of gasifying coal within an appropriately moderate temperature range while still avoiding the formation of undesirable compounds. Moderate to high temperatures are necessary to avoid formation of undesirable compounds such as tars, phenols and other aromatics. These compounds pose environmental and safety hazards if emitted into the atmosphere.

SUMMARY OF THE INVENTION

The present invention is a method for catalytically aiding the gasification of an anthracite coal, a bituminous coal, or a petroleum coke feed, which includes (a) mixing with a dry carbonaceous feed at least one additive compound selected from carbonates, bicarbonates, or sulfates of potassium, calcium, sodium, or magnesium; and (b) gasifying the coal feed in the resulting mixture in an entrained flow gasifier under gasifying conditions and at a temperature of from about 2000° F. to about 3200° F., thereby producing a gas primarily consisting of hydrogen and carbon monoxide, wherein the additive compound catalytically aids in producing said hydrogen and carbon monoxide.

DESCRIPTION OF THE PREFERRED EMBODIMENTS

A. Feeds and Additive Compounds and Mixture Thereof

Feed sources for use with the method of this invention include anthracite coals, bituminous coals, and petroleum coke. The additive compounds for use with the process of this invention are those which will catalytically facilitate the gasification of the feed into synthesis gas. These compounds include potassium, calcium, sodium, or magnesium carbonates, bicarbonates, or sulfates. Potassium or calcium carbonates are preferred and calcium carbonates are more preferred for their economy and availability. The additive compounds are optionally used individually or in combination.

The coal feed and the additive compound are mixed either in the gasifier or upstream of the gasifier. A particularly efficient method of mixing is to pulverize both the feed and the additive compound together in the pulverizer. The coal feed or the additive compound are fed to the gasifier either dry or in a water slurry. If the additive compound is not mixed with the feed prior to introducing the feed into the gasifier, then the additive compound is pulverized separately from the feed and is mixed with the feed after the pulverizing stage or is injected independently of the feed into the gasifier. In independent injection of the additive compound to the gasifier, it is either transported pneumatically in nitrogen or carbon dioxide or is carried in a water slurry.

B. Reaction, Conversion, Cooling, and Solids Removal

In the gasifier the coal partially oxidizes to form synthesis gas which is primarily carbon monoxide and hydrogen. The additive compound catalytically aids this reaction and allows it to occur efficiently at lower gasifier temperatures than would be possible without the additive.

The synthesis gas produced is then passed from the gasifier to one or more quenching and/or cooling stages and/or heat recovery stages. Flyash is cooled to condense to solid particles. The synthesis gas stream containing the solid particles is passed to one or more solids removal stages. The solids removal stage is preferably a cyclone or ceramic candle filter, used individually or in combination. An electrostatic precipitator is optionally used where the system is at or near atmospheric pressure. The synthesis gas is recovered from the solids separation stage.

C. Concentrations of Additive Compound and Percent Removal

The concentration of additive compounds in the feed material varies widely with the type and source of the feed. As a result, varying levels of additive compound are needed to correspond to the reactivity level of the feed.

At least an effective amount of additive compound is added to catalytically facilitate the partial oxidation reaction converting the coal feed to synthesis gas. The amount of additive added is not more than about 5 percent by weight based on the weight of the coal feed. Preferably, the amount of additive mixed with the feed is from about 1 percent additive by weight to about 4 percent additive by weight based on the coal feed. This assures a high degree of conversion of the coal. More than about 5 percent is wasteful of the additive compounds and makes the process uneconomical without any apparent benefit.

D. Operating Conditions

The gasifier is operated at gasifying conditions. These conditions may vary from feed to feed. The temperature is a temperature high enough to gasify a substantial portion of the coal feed without production of undesirable side-products such as aromatics. Typical temperatures in the gasifier are from about 2000° F. to about 3200° F. The gasifier temperature is preferably from about 2600° F. to about 2900° F., preferably from about 2600° F. to about 2750° F., and more preferably from about 2600° F. to about 2650° F. The pressure of the gasifier is greater than about 200 psig, preferably greater than about 300 psig, and more preferably from about 300 psig to about 450 psig.

EXAMPLE and ILLUSTRATIVE EMBODIMENT

The following example and illustrative embodiment are not intended to limit the scope of the invention.

In this example and illustrative embodiment, a 250-ton/day dry feed entrained flow coal gasification reactor was operated with a feed of bituminous coal (Pyro #9, from Western Kentucky). In the comparative example (not of the invention), the temperature in the gasifier was between 3000° F. and 3030° F. as indicated in the Table, and the pressure was between 350 psig and 370 psig. As shown, increasing the temperature from 3000° F. to 3030° F. had no measurable effect on percent conversion of carbon in the feed. Percent conversion was measured by measuring the amount of unreacted carbon in the ash recovered from the process.

In the illustrative embodiment of the invention, the same process conditions were followed except that the temperature was lower initially and additives were added. Calcium carbonate, as limestone, was added to the feed before the coal pulverizer in an amount between 1.5% to 2% weight based on the weight of the coal feed. As shown in the Table, at gasifier temperatures of both 2950° F. and 3000° F., the feed with additive had a higher conversion than that of the example, without additive, and at a higher temperature of 3030° F. Accordingly, the addition of additive increased reactivity and allowed the process to operate at lower temperatures.

TABLE

ENHANCEMENT OF REACTIVITY OF COAL BY USE OF ADDITIVES

| TEMPERATURE | ADDITIVE | PERCENT CONVERSION |
|---|---|---|
| 3000° F. | none | 97–97.5 |
| 3030° F. | none | 97–97.5 |
| 2950° F. | $CaCO_3$ (1.5–2%) | 98.8–99.2 |

TABLE-continued

ENHANCEMENT OF REACTIVITY OF COAL BY USE OF ADDITIVES

| TEMPERATURE | ADDITIVE | PERCENT CONVERSION |
|---|---|---|
| 3000° F. | $CaCO_3$ (1.5–2%) | 99–99.3 |

What is claimed is:

1. A method for catalytically aiding the gasification of an anthracite coal, a bituminous coal, or a petroleum coke feed comprising:

(a) admixing with a dry feed containing not more than about 20 percent by weight ash, a feed selected from the group consisting of anthracite coal, bituminous coal, or petroleum coke feed, a dry additive compound selected from at least one carbonate, bicarbonate, or sulfate of potassium, calcium, sodium, or magnesium; and (b) gasifying the feed in the resulting dry mixture in an entrained flow gasifier under gasifying conditions and at a temperature of from about 2000° F. to about 3200° F., thereby producing a gas comprising hydrogen and carbon monoxide, wherein the additive compound catalytically aids in producing said hydrogen and carbon monoxide and wherein said additive compound does not substantially aid in removal of vanadium and nickel.

2. The method according to claim 1 wherein said feed is petroleum coke.

3. The method according to claim 1 wherein said feed is bituminous coal.

4. The method according to claim 3 wherein the temperature in the gasifier is from about 2600° F. to about 2900° F.

5. The method according to claim 3 wherein the amount of additive compound admixed with the feed is not more than about 5 percent by weight based on the coal feed.

6. The method according to claim 5 wherein the amount of additive compound admixed with the feed is from about 1 percent by weight to about 4 percent by weight based on the coal feed.

7. The method according to claim 3 further comprising a coal or coke feed pulverizing stage upstream of the gasifier and wherein the additive compound is admixed with the coal or coke feed at the pulverizing stage.

8. The method according to claim 3 further comprising a coal feed pulverizing stage and wherein the additive compound is admixed with the coal feed after the pulverizing stage.

9. The method according to claim 3 wherein the additive compound is selected from the group consisting of calcium carbonate, potassium carbonate, and mixtures thereof.

10. The method according to claim 9 wherein the additive compound is calcium carbonate.

11. A method for catalytically aiding the gasification of bituminous coal comprising:

(a) admixing a dry bituminous coal feed containing a sufficient ash content wherein nickel and vanadium build-up is not present in the gasifier and containing not more than about 20 percent by weight ash with a dry additive compound selected from the group consisting of potassium carbonates, calcium carbonates, and mixtures thereof;

(b) gasifying the coal feed in the resulting dry mixture in an entrained flow gasifier under gasifying conditions and a temperature of from about 2650° F. to about 2750° F., thereby producing a gas comprising hydrogen and carbon monoxide; and (c) wherein the additive compound catalytically aids in producing said hydrogen and carbon monoxide.

12. The method according to claim 11 wherein the pressure in the gasifier is greater than about 200 psig.

13. The method according to claim 12 wherein the pressure in the gasifier is from about 300 psig to about 450 psig.

14. The method according to claim 12 wherein the additive compound is selected from the group consisting of calcium carbonate, potassium carbonate, and mixtures thereof.

15. The method according to claim 14 wherein the additive compound is calcium carbonate.

16. A method for catalytically aiding the gasification of bituminous coal comprising:

(a) admixing a dry bituminous coal feed containing from about 10 to about 20 percent by weight ash with a dry calcium carbonate additive wherein the amount of additive admixed is from about 1 percent by weight to about 4 percent by weight based on the coal feed;

(b) gasifying the coal feed in the resulting dry mixture in an entrained flow gasifier, wherein the pressure in the gasifier is greater than about 300 psig and wherein the temperature in the gasifier is from about 2600° F. to about 2650° F., thereby producing a gas comprising hydrogen and carbon monoxide; and (c) wherein the additive compound catalytically aids in producing said hydrogen and carbon monoxide, whereby gasification occurs at moderate temperatures.

* * * * *